US011236972B1

(12) United States Patent
Medina

(10) Patent No.: US 11,236,972 B1
(45) Date of Patent: Feb. 1, 2022

(54) FORCIBLE ENTRY BREACHING BALLISTIC SHIELD

(71) Applicant: Dennis Medina, Miami, FL (US)

(72) Inventor: Dennis Medina, Miami, FL (US)

( * ) Notice: Subject to any disclaimer, the term of this patent is extended or adjusted under 35 U.S.C. 154(b) by 0 days.

(21) Appl. No.: 17/233,961

(22) Filed: Apr. 19, 2021

(51) Int. Cl.
*F41H 5/08* (2006.01)
*E04G 23/08* (2006.01)

(52) U.S. Cl.
CPC ..... *F41H 5/08* (2013.01); *E04G 23/08* (2013.01); *E04G 2023/088* (2013.01)

(58) Field of Classification Search
CPC ..... F41H 5/08
See application file for complete search history.

(56) References Cited

U.S. PATENT DOCUMENTS 7,302,880 B1 * 12/2007 Elasic ..... F41H 5/08 89/36.01
2014/0233235 A1 * 8/2014 Micarelli ..... F41H 5/08 362/253
2017/0268854 A1 * 9/2017 Spransy ..... F41H 5/08

* cited by examiner

*Primary Examiner* — J. Woodrow Eldred

(57) ABSTRACT

The present invention discloses a ballistic shield for providing protection to police personnel and the like. The ballistic shield includes a door breaching assembly that permits the police personnel to breach a door of a suspected property. The ballistic shield is made of material that resists projectile and ballistic explosions. The door breaching assembly of the ballistic shield is designed in such a way that it is suitable for breaching both inward and outward opening or swinging doors.

20 Claims, 6 Drawing Sheets

FORCIBLE ENTRY BREACHING BALLISTIC SHIELD

FIELD OF INVENTION

The present invention relates to handheld shields used by law enforcement personnel for personal protection during hazardous situations. More particularly, the present invention relates to a protective shield for protecting the law enforcement personnel from dangerous situations where attacks may be directed at the personnel when breaching a door. Specifically, the present also relates to a ballistic shield for protecting the law enforcement personnel from projectile or ballistic attacks when breaching the door.

BACKGROUND OF THE INVENTION

Law enforcement, military and security personnel are often asked to perform duties in areas where they are at risk of injury from gunshots, explosions, and projectiles. For example, persons who are responsible for breaching an entrance to a building are often at risk of attack. In such settings, there is a need for barriers that can provide protection to the security or police personnel. In real life law enforcement, breaching doors to gain entry has been around as long as the profession itself. There are five different ways of forcible entry into a building or at the entrance, which law enforcement personnel have at their discretion. The different ways include mechanical breaching, hydraulic breaching, ballistic breaching, explosive breaching and thermal breaching.

Mechanical breaching is the breaching in which various kinetic and strength force tools are used for gaining entrance to a building typically through a door. Mechanical breaching is quick, effective and minimally destructive. For most outward opening doors, one of the best tools known in the prior art is the Halligan tool. It works in conjunction with a sledge-hammer or a ram. The flat part of the tool i.e. the duckbill, is inserted in the crack of the door, right above or below the lock, and it is forced therein with a hammer or ram. Then using leverage, you pull on the opposite end of the tool to defeat the locking mechanism and ultimately forcing the door open. Even though it is an excellent tool with many advantages, it has its disadvantages. The main disadvantage is that it lacks ballistic protection in law enforcement use. In addition, the Halligan device does not provide any marking to let you know how deep into the door the tool has traveled.

Apart from these mechanical tools, the security personnel use a shield for protecting themselves while breaching the entrance or the door of a residence, building or other structure. The shield has been used since ancient times for protecting soldiers. Nowadays, the shield is used, for among other reasons, by security personnel or police for protecting themselves while breaching an entrance or a door or protecting themselves during riots and violent situations or conflicts. It is the policy of the security personnel or police to use the shield for defensive purposes such as establishing a perimeter during riots like situations.

It is under this practice that while breaching the door, the law enforcement officers at times need to engage suspects who are barricaded within structures. Generally, a sole officer holds a shield for protection while others carry mechanical tools for breaking a door to gain entrance. However, the shield and the door breaking tools are inconvenient and require at least a two-person operation. Thus, there is a need for a portable, hand-carried protective shield integrated with a door breaching tool that may be deployed and used by on officer to protect personnel and enter enclosed structures. Some examples of patents relating to shields are as described below, but all lack in providing a forcible entry breaching ballistic shield.

A Chinese patent CN206891271 assigned to Lou Chunchun discloses a kind of police shield. The police shield includes a body, an arm fixing plate and an inner lining layer; the upper middle of the body is provided with an observation window. The police shield described provides protection from bad actors about to attack and allows the security personnel to view dangerous situations through the observation window. However, the police shield does not provide protection from gunshots or ballistic explosions. The police shield does not incorporate any means for breaking or opening a door of a structure in which the suspect or bad actor resides.

Another U.S. Publication 20170268854 assigned to DAW Technologies LLC discloses a ballistic breacher shield that has a combined shield with a battering ram functionality. The breacher shield's design permits an officer assigned to breach a structure to have shield protection as he approaches the structure, a battering ram to break open the structure, and then shield protection again once the barrier has been breached. Although the breacher shield described provides a ram for breaching a structure and provides protection to the officer once the structure has been breached, during breaching use the shield fails because the user as to turn it on its end to access the battering ram member to attack the door or other object. With this device, there is no ballistic shield protection during the actual breach which is generally the most dangerous time of the security operation.

Therefore, there is a need for a lightweight and easy to operate ballistic shield with an integrated a door-breaching and prying tool, which provides easy breaching of a door by a single individual while still providing shielding protection, thus resulting in access to the structure to be breached while still offering an officer or officers ballistic protection.

It is apparent now that numerous methods and systems have been developed in the prior art that are adequate for various purposes. Furthermore, even though these devices may be suitable for the specific purposes to which they address, they would not be suitable for the purposes of the present invention as heretofore and hereinafter described. Thus, there is a need for a light-weight and efficient ballistic shield for providing protection to security personnel or police while enabling them to use such a shield to breach a structure through a door.

SUMMARY OF THE INVENTION

In accordance with the present invention, the disadvantages and limitations of the prior art are substantially avoided by providing a ballistic shield for securely breaching a door and additionally providing protection to security personnel and the like from being attacked by bad actors or suspects who reside behind the door. The ballistic shield includes a shield having a front side, a rear side, a pair of opposing sides, a top end and a bottom end.

Further, the ballistic shield includes a door breaching assembly for successfully breaching the door. The door breaching assembly includes at least one door-prying wedge disposed on one of the opposing sides of the ballistic shield, and preferably two door-prying wedges opposing each other. Further, the door-prying wedges are disposed at a distance from the opposing sides of the ballistic shield. The door-prying wedges at the opposing sides are connected to the shield with a bar between the wedges. Further, the ballistic shied includes a means for securing the door breaching assembly on the front side of the ballistic shield.

In one embodiment of the present invention, the door-prying edge further includes a fore prying wedge and an aft butt end. The aft butt end of the door-prying wedge engages with the door for inward opening or swinging doors the same as a battering ram, by striking the door to force it to open inwardly.

The ballistic shield also includes a handle secured on the rear side for holding the shield. In one embodiment of the present invention, the ballistic shield includes a pair of vertical handles on the rear side for holding the shield. The pair of vertical handles are connected to the shield with multiple rods on the rear side. Further, the pair of vertical handles connect with each other through another rod. The handle allows easy carrying of the ballistic shield for breaching the door by a single user. In addition, the pair of vertical handles provides strong gripping and prying leverage of the ballistic shield for easy operation while breaching or penetrating a door.

The ballistic shield further includes a bulletproof glass near the top end of the shield to allow see-through capability from the rear side towards the front side of the shield. The bulletproof glass acts as an observation window near the top end and also provides ballistic protection to the law enforcement or security personnel.

In one embodiment of the present invention, the shape of the shield is either substantially planar or a somewhat semi arcuate, with trapezoidal or rectangular geometry.

In another embodiment of the present invention, the ballistic shield further includes an M-shaped cut-out at bottom end of the shield for protecting a user on the rear side of the shield. More particularly, the M-shaped cut-out protects the hip, upper thighs and groin areas of the user.

It is thus an object to provide a shield with door-prying wedges to enable them to engage between dead-bolt locks and a door handle of the door, and the door jamb, while still providing shield protection.

In an embodiment of the present invention, the door-prying wedge for breaching the door includes multiple indentations distributed across its length indicating the depth of the wedge to be inserted in the door jamb for forcing a door open for an outward swinging door. In one embodiment of the present invention, a first indentation is provided at a depth of approximately two inches for an outward opening door. In another embodiment of the present invention, a second indentation is provided at the depth of approximately four inches for an outward opening door. The door-prying wedge is wider at its aft butt end than its fore end and is approximately six inches in length.

It is still another object of the present invention, to provide for ballistic shield with door breaching capability that can be handled by one person and is in the range of thirty to thirty five pounds.

In another embodiment of the present invention, the ballistic shield includes a square shaped handle to allow easy carrying of the ballistic shield for breaching the door and for being able to rotate the shield from top end to bottom end and vice versa.

In yet another embodiment of the present invention, a hand-held protective shield for securely breaching a door by security personnel comprises a shield with a front side, a rear side, a pair of opposing sides, a top end and a bottom end. In addition, the hand-held protective shield includes a single door breaching assembly for breaching the door, and comprises a door-prying wedge at one end, and is connected to a D-shaped or triangle-shaped handle at the other. The door breaching assembly is secured onto the shield with a bar on the shield's front side.

In still yet another embodiment of the present invention, a ballistic shield includes a shield with a front side, a rear side opposing sides, a top end and a bottom end. Further, the ballistic shield includes a door breaching assembly for securely breaching a door. Additionally, the door-breaching assembly includes at least one door-prying wedge and at least one battering member opposite the door-prying wedge. The door breaching assembly is disposed at one opposing side and at a distance from the shield. Further, the ballistic shield includes a means for connecting the door-prying wedge to the shield. Moreover, the ballistic shield includes a handle secured on the rear side for holding the shield.

Although, the invention is described above in terms of various exemplary embodiments and implementations, it should be understood that the various features, aspects and functionality described in one or more of the individual embodiments are not limited in their applicability to the particular embodiment as they are described, but instead can be applied, alone or in various combinations, to one or more of the other embodiments of the invention, whether or not such embodiments are described and whether or not such features are presented as being a part of a described embodiment. Thus, the breadth and scope of the present invention should not be limited by any of the above-described exemplary embodiments.

BRIEF DESCRIPTION OF THE DRAWINGS

The objects and features of the present invention will become more fully apparent from the following description and appended claims, taken in conjunction with the accompanying drawings. Understanding that these drawings depict only typical embodiments of the invention and are, therefore, not to be considered limiting of its scope, the invention will be described and explained with additional specificity and detail through the use of the accompanying drawings in which:

DETAILED DESCRIPTION OF THE INVENTION

The present invention provides a forcible entry breaching ballistic shield for securely breaching a door. The ballistic shield includes a shield for protecting a user from attacks directed at the user from within a structure. The attacks may be in the form of, typically, projectile gunshots, but can be from stones, ballistic explosions and the like. The shield of the ballistic shield includes a front side and a rear side, opposing sides, a top end and a bottom end. Further, the ballistic shield includes a door breaching assembly. The door breaching assembly is utilized for breaching the door of a suspected property, like a suspect's house, suspected factory, store, garage or other structures having a door.

The ballistic shield further includes at least one door-prying wedge for engaging with a door and thereby breaking or opening the door. The ballistic shield further includes a bullet proof window at top end of the shield. The bulletproof glass allows a user to see through from the rear side towards the front side.

Furthermore, the door breaching assembly includes a pair of vertical handles disposed on the rear side of the shield. The pair of vertical handles connect with a transverse rod on the rear side of shield. The pair of vertical handles allows easy carrying of the ballistic shield for breaching the door. In addition, the pair of vertical handles provides a solid grip to the user of the ballistic shield.

Figure 1A:
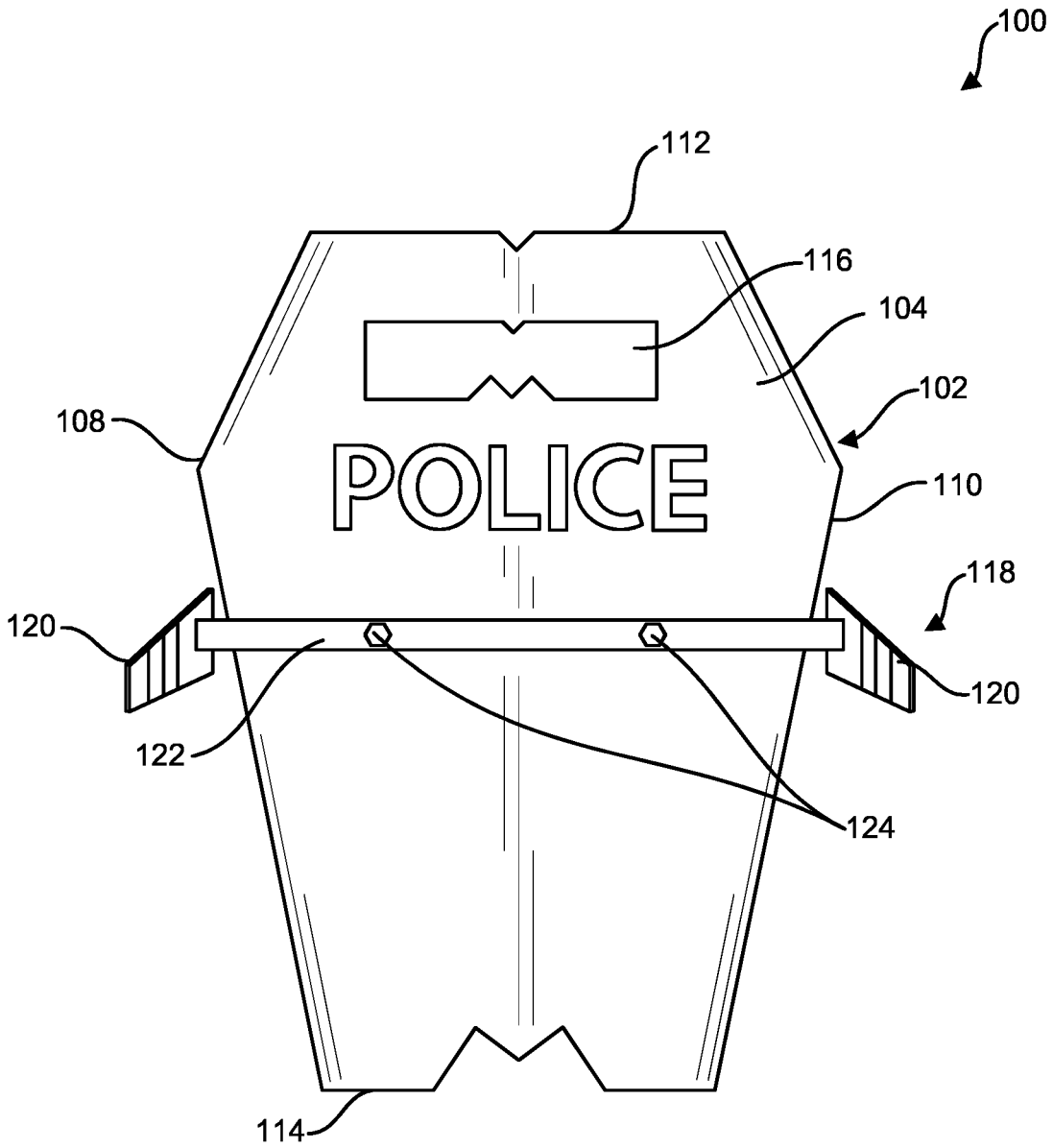
FIG. 1A illustrates the front view of a ballistic shield in accordance with the present invention.

FIG. 1A represents a front view of a ballistic shield (100) in accordance with the present invention. The ballistic shield (100) includes a shield (102) for protecting a user. The shield (102) protects the user from attacks directed at the user. In a preferred embodiment, the ballistic shield (100) is hand-held and protects its law enforcement personnel or user. The shield (102) of the ballistic shield (100) may be made of material that is solid and rigid, and projectile proof or resistant. The shield (102) facilitates protection to the user from being attacked by occupants from inside of the structure to be breached. The user may be police personnel, military personnel, swat personnel, FBI agents and the like. In a preferred embodiment, the ballistic shield (100) is easily deployable, light enough to carry by one user, and protective.

The shield (102) includes a front side (104), a rear side (106), a pair of opposing sides (108, 110), a top end (112) and a bottom end (114). The shield (102) can be made of any protective material for the intended purpose of breaching and protecting, such as boron nitride, tungsten carbide, tungsten disulfide, aluminum nitride and the like. The shield (102) provides Level IV ballistic protection from ballistic attacks. The shield (102) protects the user from assault rifle rounds, handgun rounds, pistol rounds, sniper rounds and the like. Though the shield (102) may be of any shape or size, it is preferred that it be substantially planar or semi-arcuate. The shield (102) geometry is preferably a rectangular or trapezoidal shape or the like. The shield (102) allows the user to hide behind it substantially completely and thereby protects him or her from attack.

Further, the shield (102) can include a window (116) near the top end (112) of the shield (102). The window (116) allows the user to see through the shield (102) from the rear side to the front side of the shield (102). Further, a bulletproof glass covers the window (116) that protects the user from the occupant-attacker's gunshots and projectiles. In general, the bulletproof glass typically resists a bullet or projectile from firearms and the like to pass therethrough.

The bulletproof glass can be made of polycarbonate, acrylic, or glass-clad polycarbonate. In addition, the bulletproof glass includes an M-shaped cutout at bottom end thereof.

Further, the ballistic shield (100) includes a door breaching assembly (118) configured for breaking and opening the door of a structure. The door breaching assembly (118) is utilized for securely breaching the door of a suspected property. The suspected property may be a suspect's house, a factory, a store, a garage and like structures. The door breaching assembly (118) includes at least one door door-prying wedge (12), but preferably a pair of door-prying wedges (120), that can engage with the door to be breached. More specifically, the wedge or pair of door-prying wedges (120) are disposed at a distance from opposing sides (108, 110) of the shield (102) respectively, which further engages with the door to be breached. The distance of the at least one door-prying wedge (120) from an opposing side (108 or 110) of the shield (102) should be in the range of two inches to twenty four inches from the side (108 or 110), and preferably approximately six inches from the side (108 or 110).

The door prying wedges (120) are connected via a means to the front side (104) of the shield (102). More specifically, the pair of door prying wedges (120) is connected with a transverse bar (122) that is situated between the wedges (120). Further, the pair of door prying wedges (120) and bar (122) are attached to the front side (104) of the shield through securing means (124). More specifically, the pair of door prying wedges (120) and bar (122) are secured to the front side (104) of the shield (102) through multiple bolts, rivets, welds, or the like connecting the bar (122) to the shield front (104).

In a preferred embodiment, the door-prying wedges (120) are made of a solid material like a metal or similar material. The solid material may be iron, aluminum, copper, zinc, an alloy or the like. Also in a preferred embodiment, the bar (122) is also made of a metal or metal alloy. The solid material for the bar (122) can be iron, aluminum, copper, zinc, an alloy or the like.

The door-prying wedge (120) of the door breaching assembly (118) engages with the door of the suspected property. In a preferred embodiment, the door breaching assembly (118) is utilized for breaching an outward opening or swinging door of the suspected property by prying it open. In a preferred embodiment, the door breaching assembly (118) is utilized for breaching an inward opening or swinging door of the suspected property also by ramming it open with the breaching assembly (118).

More specifically, at least one of the pair of door-prying wedges (120) is engaged between the dead-bolt locks and the door handle of the door in order to breach the door, and leveraged against the door jamb. The door-prying wedge (120) further includes multiple indentations or markings distributed across the width of the wedge for showing that portion of the door-prying wedge (120) that is to be inserted between the door and door jamb. The door-prying wedges (120) are thin and narrow in size, thereby allowing the door-prying wedges (120) to slide between the door and doorjamb.

Figure 1B:
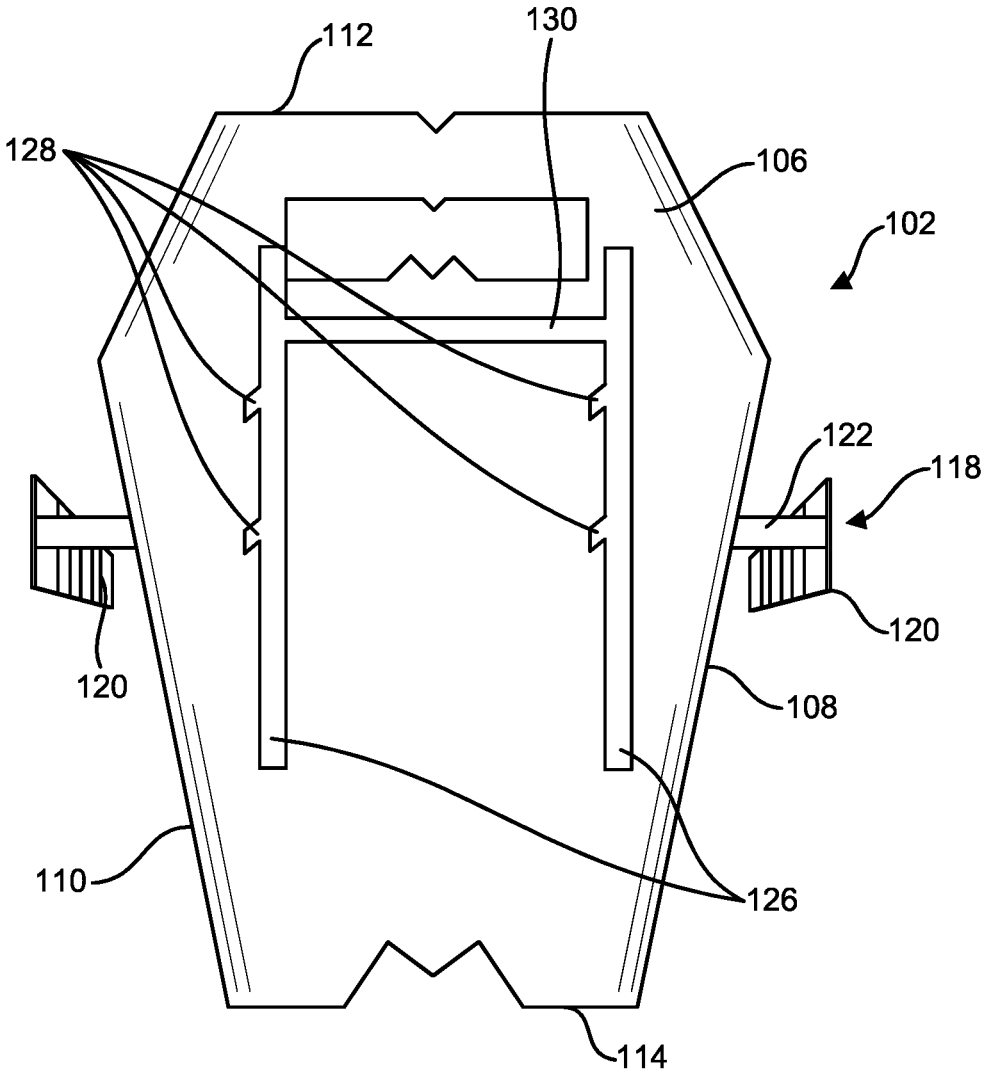
FIG. 1B illustrates the rear view of the ballistic shield in accordance with the present invention.

FIG. 1B represents a rear view of the ballistic shield (100) in accordance with the present invention. The ballistic shield (100) includes the shield (102) allowing the user to hide behind it substantially completely, which protects the user from projectile material.

The shield (102) further includes an M-shaped cut-out at its bottom end (114) for protecting the user on the rear side (106) of the shield (102). More specifically, the M-shaped cut-out at the bottom end (114) of the shield (102) allows protection to the hip area, upper thighs, and groin area of the user. Additionally, the M-shaped cut-out at the bottom end of the shield (102) makes the shield (102) lighter in weight than without any cutout as some shield material is eliminated thus lightening it.

In a preferred embodiment, the ballistic shield (100) weighs in the range of thirty pounds to thirty five pounds. Further, the ballistic shield (100) may be easily stored, as it does not require much space for storage, given that it is substantially planar or semi-arcuate. Moreover, the ballistic shield (100) is configured for both left handed and right handed users, and for breaching doors whether the doorjamb is left or right of the door.

Further, the ballistic shield (100) includes a pair of handles (126) for easily deploying the shield (102) at the required time by an individual user. More specifically, the pair of vertical handles (126) provide a solid grip to the user for handling the ballistic shield (100). The pair of vertical handles (126) allows the user to apply adequate amounts of force during breaching the left handed or right handed door of the suspected property. The pair of vertical handles (126) allows the user to apply the force in multiple directions. In addition, the pair of vertical handles (126) allows the user to attack the suspected occupants as well, if necessary, by applying force in a forward direction while still being situated behind the shield. The pair of vertical handles (126) is of a solid, protective material and can include iron, copper, aluminum, zinc, steel, brass, a metal alloy or the like.

The vertical handles (126) are connected with a multiple rods or spacers (128) on the rear side of the shield (102). The multiple rods (128) are solid, and can be made of iron, copper, aluminum, zinc, steel, brass, a metal alloy or the like. The pair of vertical handles (126) is connected to the shield (102) using securing means. The securing means may be bolt-screw assemblies, welding, gluing, adhesive and the like. The pair of vertical handles (126) is also connected to each other through a transverse middle rod (130) which allows the user to apply maximum force or door-prying leverage.

In the embodiment of the present invention, the user may use the ballistic shield (100) regardless whether the user is right-handed or left-handed. The user may be able to hold the vertical handles (126) using only one hand. The ballistic shield (100) may be used either in a vertical direction or in a horizontal direction for protecting himself or herself.

Figure 2A:
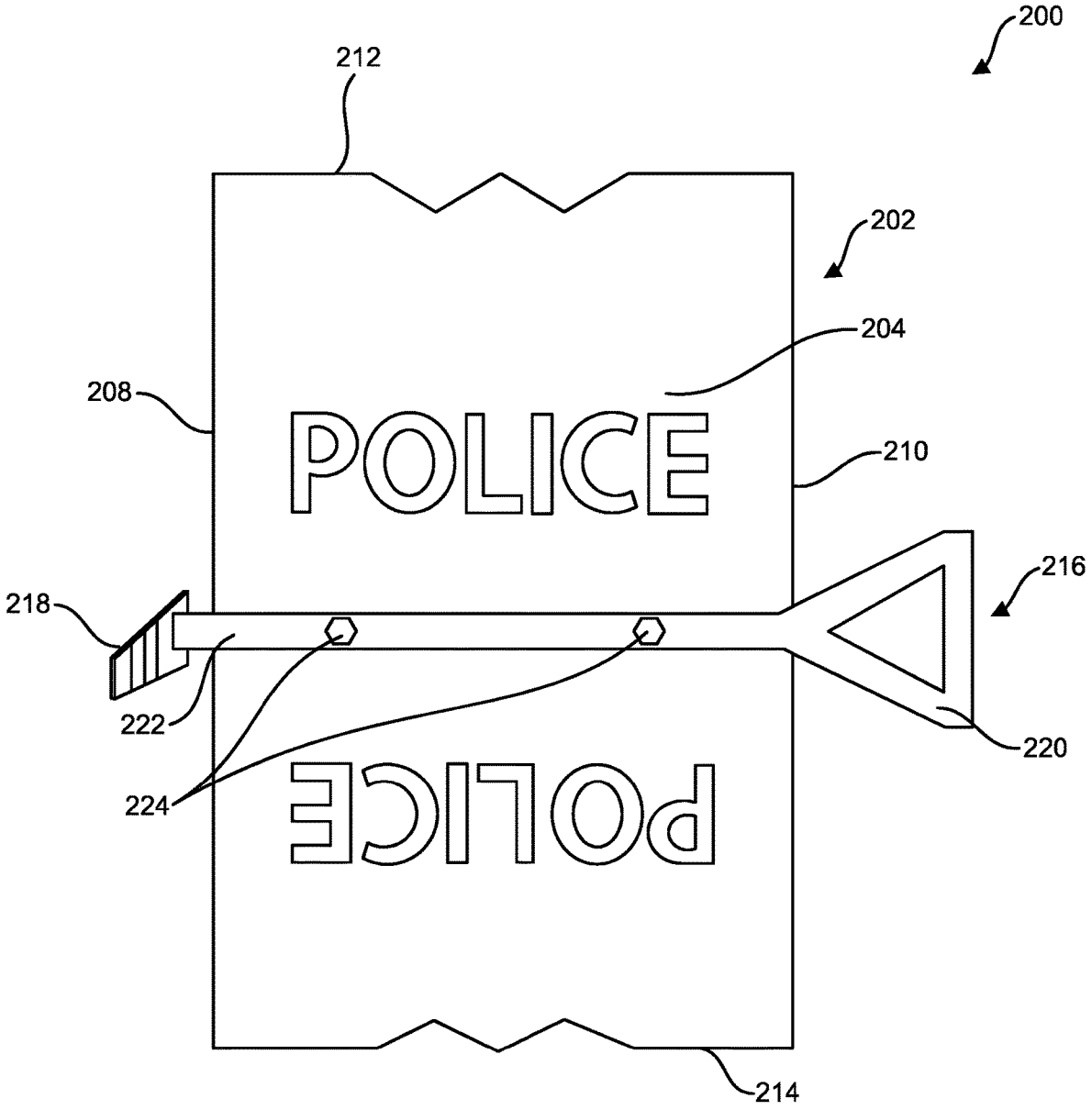
FIG. 2A illustrates the front view of an alternative embodiment of the ballistic shield in accordance with the present invention.

FIG. 2A represents an alternative embodiment of the present invention comprising a front view of a hand-held protective shield (200). The protective shield (200) includes a shield (202) for protecting a user from attacks while breaching the door of a structure. The protective shield (200) is hand-held shield, and is solid, or rigid, and protective for the user.

Figure 2B:
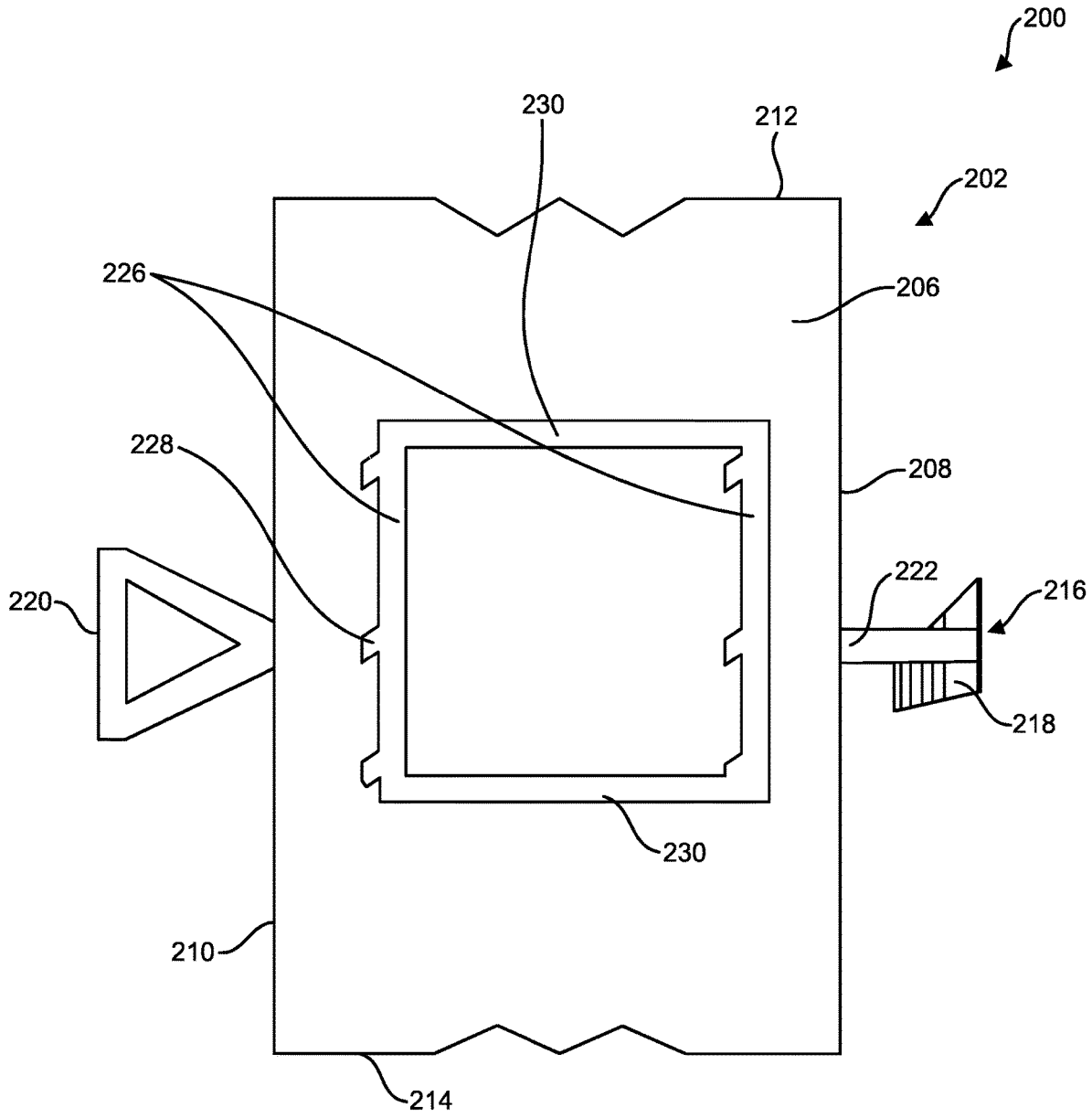
FIG. 2B illustrates the rear view of the alternative embodiment of the ballistic shield in accordance with the present invention.

The shield (202) includes a front side (204), a rear side (206) (as shown in FIG. 2B), a pair of opposing sides (208, 210), a top end (212) and a bottom end (214). The shield (202) facilitates protection to the user from being attacked. The user may be police personnel, military personnel, swat personnel, FBI agents and the like. The attackers or suspects can be armed, but are otherwise occupants, lawbreakers, bad actors or the like.

The shield (202) typically is made of a metal like boron nitride, tungsten carbide, tungsten disulfide, aluminum nitride, an alloy and the like to provide protection to the user against, typically, ballistic projectiles. The protective shield (200) provides Level IV ballistic protection. The shield (202) can be in the shape of rectangle, trapezoid or any shape alike, and is substantially planar or semi-arcuate.

Further, the protective shield (200) includes at least one door breaching assembly (216) for securely breaching the door of a suspected property. The suspected property may be house, factory, store, garage or like structure.

The door breaching assembly (216) includes a door-prying wedge (218) for engaging with the door to be breached. More specifically, the door-prying wedge (218) is disposed at a distance from between two to twenty four inches, and preferably approximately six inches, from one of the opposing sides (208) of the shield (202). The door-prying wedge (218) is made of a solid metal material like iron, aluminum, copper, zinc, a metal alloy or the like.

The door breaching assembly (216) further includes a D-shaped or triangular-shaped handle (220) on the side (210) of the shield (202) opposite that of the door-prying wedge (218). Thus, the door-prying wedge (218) and the D-shaped handle (220) are disposed at the opposing sides (208, 210), respectively, of the shield (202). The door-prying wedge (218) is connected to the D-shaped handle (220) with a bar (222) on the front side (204) of the shield (202). The bar is made of a solid metal material like iron, aluminum, copper, zinc, an alloy or the like. More specifically, the door-prying wedge (218) and the D-shaped handle (220) are connected to the shield (202) by a bar (222) using a securing means (224). The securing means (224) may be bolts-screw assemblies, welding, and like means. The door-prying wedge (218) of the door breaching assembly (216) engages with the door of the suspected property, and between the door and door jamb.

The door breaching assembly (216) is utilized for breaching a door by prying one that is outward opening of the suspected property, or the door breaching assembly (216) is utilized for breaching into an inward opening or swinging door of the suspected property by ramming it. In addition, the door-prying wedge (218) is wider at its base than its top, and preferably is about from five inches width at its base and approximately two inches width at its top. The door-prying wedge (218) is substantially thin enough so that it can slide between the deadbolt locks and the door handles of the door, and the door jamb. The door-prying wedge (218) of the door breaching assembly (216) has an overall length of about six inches.

The D-shaped or triangular shaped handle (220) provides additional leverage to the user to pry a door open. The user, standing behind the protective shield (200), may be able to apply more force using the D-shaped handle (220) in order to breach the door of the suspected property. The D-shaped handle (220) also provides additional support and use of force to ram open an inward opening or swinging door.

FIG. 2B illustrates a rear view of the protective shield (200) in accordance with an alternative embodiment of the present invention. The protective shield (200) includes the shield (202). The shield (202) includes the M-shaped cutout bottom end (214) of the shield (202) for protecting the user on the rear side of the shield. The M-shaped cutout at the bottom end of the shield (202) allows protection to the hip area, upper thigh area, and groin region of the user. Additionally, the M-shaped cutout at the bottom of the shield (202) makes the protective shield (200) lighter in weight than a shield without eliminating some of the material makeup. The protective shield (200) weighs in range of thirty pounds to thirty five pounds.

In addition, the shield (202) includes a W-shaped cutout at its top end (212). The W-shaped cutout at the top end (212) of the shield (202) mimics the M-shaped cutout of the bottom end (214) of the protective shield (200). Thus, this embodiment permits the shield (200) to be rotated from top end to bottom end to provide the door breaching assembly (216) to the right of the shield (202) or the left of the shield (202), depending upon door to door jamb location, with the deployment of a single door breaching assembly (216).

The protective shield (200) also has a handle (226) for holding the shield (202) by the user. More specifically, the protective shield (200) includes a pair of vertical handles (226). The pair of vertical handles (226) provides a solid grip to the user. The pair of vertical handles (226) allows the user to apply an adequate amount of force during the breaching of the door of the suspected property. The pair of vertical handles (226) is solid, and preferably of a metal like iron, copper, aluminum, zinc, steel, brass, or a metal alloy.

The vertical handles (226) are further connected with multiple rods or spacers (228) on the rear side of the shield (202). The multiple rods (228) are solid, metal and can be made of iron, copper, aluminum, zinc, steel, brass, an alloy or the like. The pair of vertical handles (226) is connected to the shield (202) using securing means including bolts-screws, welding, adhesive, gluing and the like. The pair of vertical handles (226) allows the user to carry the protective shield (200) easily and for good balance or for leverage in breaching the door of the suspected property. The pair of vertical handles (226) is connected to each other through a pair of transverse middle rods (230), for a substantially square or rectangular shape of the handle (226).

Figure 3:
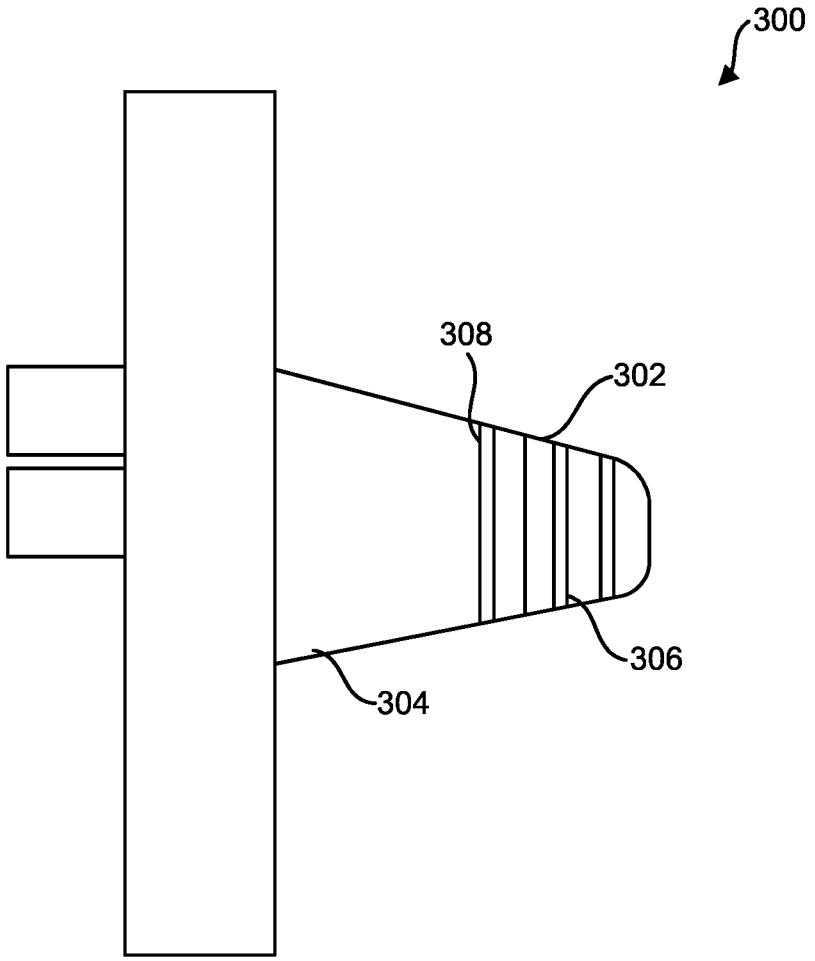
FIG. 3 illustrates a side view of a door-prying wedge in accordance with the present invention; and, FIG. 4 illustrates a technique for breaching a door with the ballistic shield in accordance with the present invention as used by police personnel.

FIG. 3 illustrates a side view of a prying wedge (300) in accordance with the present invention. The prying wedge (300) includes a fore prying wedge (302) at one end that engages a door and an aft butt end (304) opposite the fore prying wedge (302).

The fore prying wedge (302) further includes multiple indentations distributed across its depth. In one embodiment, the first indentation (306) marked at the depth of two inches for an outward opening door. In another embodiment, a second indentation (308) is at the depth of four inches for the outward opening door. These indentations represent the area of depth of the prying wedge (300) to be inserted between the door and door jamb for beaching the door.

The aft butt end (304) is an area of the prying wedge (300) that is to be used to strike or ram the door open for an inward opening or swinging door. More specifically, the aft butt end (304) is a battering member (304), which is intended to batter the door inward about the handle or locking mechanism of the door to break those members and gain entrance into the structure.

As previously disclosed and as preferred, the door-prying wedge (300) has a width at its aft butt end (304) of approximately five inches and narrows towards its fore prying wedge (302) end to approximately two inches. However, dimensions may be altered so long as there is sufficient weight behind the aft butt end (304) to ram a door open, and it has been found presently for the prying wedge (300) to have a wider butt end (304) than the narrower fore end (302). Furthermore, the prying wedge (300) is thin in size so that the door-prying wedge (300) is capable of sliding between the deadbolt locks and the door handles located on the door, and the doorjamb.

Figure 4:
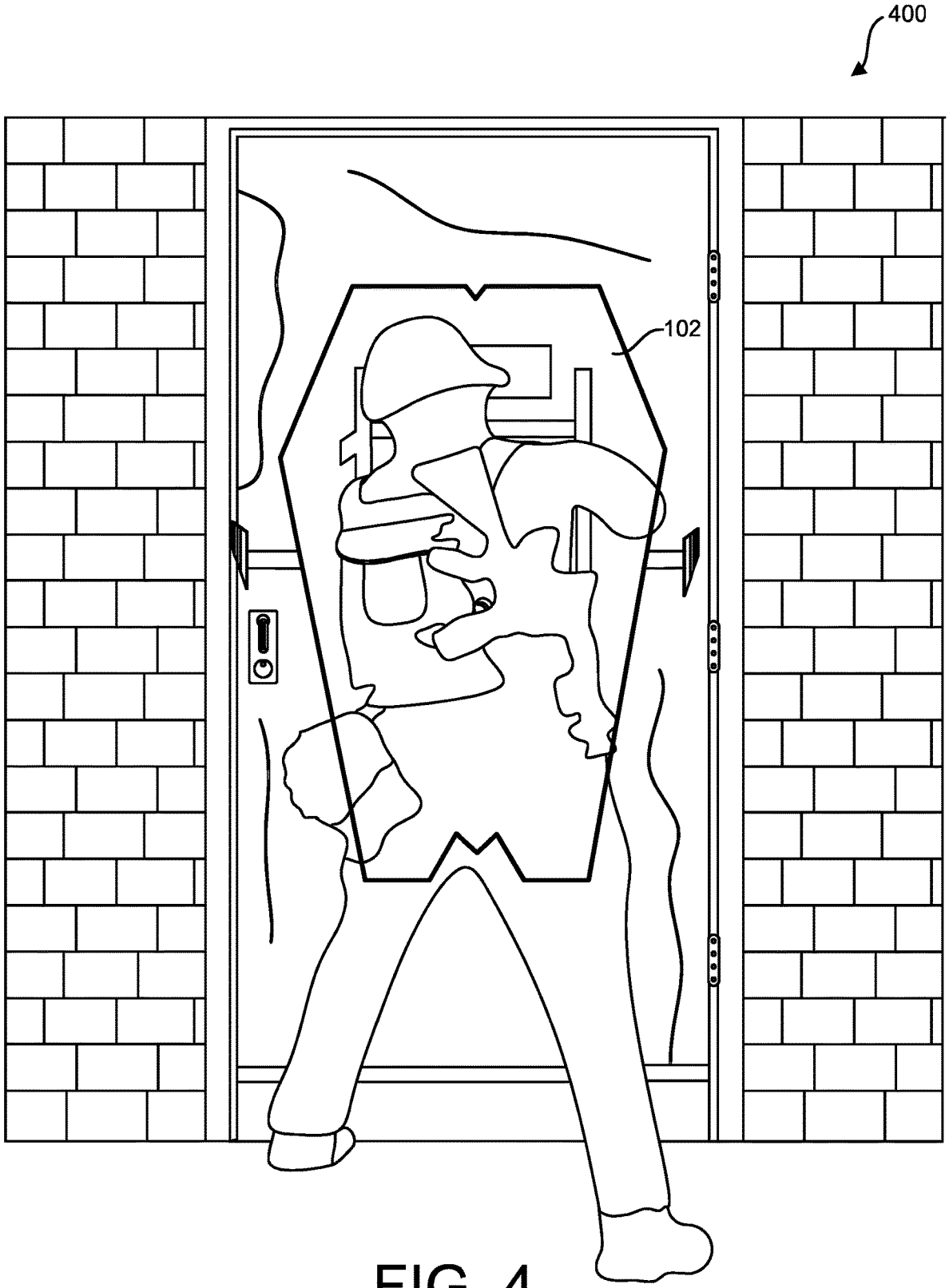

FIG. 4 illustrates a view of a ballistic shield (100) used by a user. The user holds the ballistic shield (100) from the rear side (106) by the vertical handles (126) as described in FIG. 1A and FIG. 1B. The user covers the door to be breached through the front side (104) (as described in FIG. 1A and FIG. 1B) and then engages the door-prying wedge (120) of the door breaching assembly (118) between the dead bolts and the door handle, and the door jamb. Then, by applying pressure through from opposing sides (108, 110), the door-prying wedge (120) forcibly opens the door to be breached. Alternatively, a hammer may be used for applying extra force to fit the door-prying wedge (120) between the door and the doorjamb snugly. Thus, the door, once breached, can be entered by the user and/or his or her team members.

Various embodiments of the invention are described above in the Detailed Description. While these descriptions directly describe the above embodiments, it is understood that those skilled in the art may conceive of modifications and variations to the specific embodiments shown and described herein. Any such modifications or variations that fall within the purview of this description are intended to be included herein as well. Unless specifically noted, it is the intention of the inventor that the words and phrases in the specification and claims be given their ordinary meaning to those of ordinary skill in the applicable art. Therefore, the appended claims are to encompass within their scope all such changes and modifications as are within the true spirit and scope of this invention.

The invention claimed is:

1. A ballistic shield for breaching a door, said ballistic shield comprising:

a shield with a front side, a rear side, opposing sides, a top end and a bottom end;

a door breaching assembly comprising at least one door-prying wedge disposed from at least one of said opposing sides and at a distance from said shield;

means for connecting said at least one door-prying wedge to said shield; and, handle means secured onto said rear side of said shield.

2. The ballistic shield in accordance with claim 1, wherein the shape of said shield is substantially planar or semi-arcuate.

3. The ballistic shield in accordance with claim 1, wherein said shield includes an M-shaped cut-out at said bottom end for protecting a user on said rear side of said shield.

4. The ballistic shield in accordance with claim 2, wherein said shield is either substantially rectangular or trapezoidal in geometry.

5. The ballistic shield in accordance with claim 1, wherein said at least one door-prying wedge can engage between dead-bolt locks and a handle of said door, and a doorjamb.

6. The ballistic shield in accordance with claim 1, wherein said at least one door-prying wedge comprises a fore prying wedge and an aft butt end.

7. The ballistic shield in accordance with claim 6, wherein said fore prying wedge further comprises a plurality of demarcations distributed across the width of said fore prying wedge for indicating depth of said wedge when placed into the space between said door and a doorjamb.

8. The ballistic shield in accordance with claim 7, wherein a first demarcation is at a distance of approximately two inches from the end of said fore prying wedge.

9. The ballistic shield in accordance with claim 8, wherein a second demarcation is at a distance of approximately four inches from the end of said fore prying wedge.

10. The ballistic shield in accordance with claim 6, wherein said overall length of said at least one door-prying wedge is approximately six inches.

11. The ballistic shield in accordance with claim 6, wherein said aft butt end comprises a battering member.

12. The ballistic shield in accordance with claim 6, wherein said fore prying wedge provides a means to breach an outward swinging door, and said aft butt end provides a means to breach and inward swinging door.

13. The ballistic shield in accordance with claim 1, wherein said door breaching assembly includes said at least one door-prying wedge is connected to a D-shaped handle.

14. The ballistic shield in accordance with claim 1, wherein the ballistic shield comprises a bulletproof glass disposed near said top end of said shield for allowing see-through vision by a user from said rear side towards said front side.

15. The ballistic shield in accordance with claim 14, wherein said bulletproof glass includes an M-shape cut-out at its bottom end.

16. The ballistic shield in accordance with claim 1, wherein said handle comprises a pair of vertical handles connected with a transverse rod on said rear side of said shield.

17. The ballistic shield in accordance with claim 1, wherein said door breaching assembly includes a square shaped handle.

18. The ballistic shield in accordance with claim 1, wherein said door breaching assembly comprises two door-prying wedges.

19. A hand-held protective shield for securely breaching a door, said protective shield comprising:

a shield with a front side, a rear side, opposing sides, a top end and a bottom end;

a door breaching assembly for breaching said door, wherein said door breaching assembly comprises a door-prying wedge connected to a D-shaped handle secured to said shield, further wherein said door breaching assembly is disposed from at least one of said opposing sides and at a distance from said shield;

said door-prying wedge further comprising a fore-prying wedge and an aft butt end; and, handle means secured onto said rear side for holding said shield.

20. A ballistic shield for breaching a door, said ballistic shield comprising:

a shield with a front side, a rear side, opposing sides, a top end and a bottom end;

a door breaching assembly comprising at least one door-prying wedge and at least one battering member, wherein said door breaching assembly is disposed from at least one of said opposing sides and at a distance from said shield;

means for connecting said at least door-one prying wedge to said shield; and, handle means secured onto said rear side for holding said shield.

* * * * *